United States Patent [19]

Fox et al.

[11] 4,265,085

[45] May 5, 1981

[54] RADIALLY STAGED LOW EMISSION CAN-ANNULAR COMBUSTOR

[75] Inventors: Theodore G. Fox, Newington; Melvin H. Zeisser, Marlborough, both of Conn.

[73] Assignee: United Technologies Corporation, Hartford, Conn.

[21] Appl. No.: 43,916

[22] Filed: May 30, 1979

[51] Int. Cl.[3] ..... F02C 7/22

[52] U.S. Cl. ..... 60/39.06; 60/733; 60/742

[58] Field of Search ..... 60/732, 733, 742, 752

[56] References Cited

U.S. PATENT DOCUMENTS

| | | | |
|---|---|---|---|
| 2,959,003 | 11/1960 | Carlisle et al. | 60/742 |
| 2,999,359 | 9/1961 | Murray | 60/733 |
| 3,684,186 | 8/1972 | Helmrich | 60/742 |
| 4,122,670 | 10/1978 | Reider | 60/733 |

*Primary Examiner*—Robert E. Garrett

*Attorney, Agent, or Firm*—Charles A. Warren

[57] ABSTRACT

A burner construction in which staging of combustion is obtained by a primary pressure-atomizing nozzle having a low spray angle to maintain combustion within a central core of the combustor, and a secondary fuel aerating nozzle delivering fuel in a hollow cone configuration surrounding the primary fuel spray for combustion in an annulus between the central core and the wall of the combustor. Although most of the air for primary combustion is supplied with the fuel nozzle, additional air may be introduced at the upstream end of the combustor by high penetration jets that enter the central core and additional air for secondary combustion is introduced by one or more rows of holes in the combustor wall near the upstream end.

10 Claims, 3 Drawing Figures

RADIALLY STAGED LOW EMISSION CAN-ANNULAR COMBUSTOR

BACKGROUND OF THE INVENTION

The regulations governing allowable emissions from airborne turbine engines have necessitated significant changes in the combustion system in order to meet the present levels allowed. Further revisions are necessary to meet the lower levels established for CO and hydrocarbons in the 1981 requirements and also the 1984 requirements for $NO_X$. A significant problem is a revision of the combustor without requiring a change in the dimensions of the burner. This is particularly important in retrofitting engines. Such change would require extensive design changes both in engines currently in use and in new engines. A combustor capable of meeting the proposed 1981 emissions levels without significant engine revision would permit continued use of present engines and would avoid replacement of all these engines.

SUMMARY OF THE INVENTION

A feature of this invention is to provide for staged combustion in which the two stages are coextensive axially, with the secondary stage surrounding the primary stage. To accomplish this, primary fuel is introduced in a low angle atomized spray so that combustion occurs in a fuel rich core centrally of the combustor. This fuel-rich core provides an optimum environment for reducing hydrocarbon and carbon monoxide emissions. Stoichiometry can be optimized.

Another feature is the introduction of secondary aerated fuel at above idle and at high power design points in the form of a hollow cone surrounding but desirably not blending with any of the core. Additional air is introduced through small holes in the combustor wall designed for air penetration only into the secondary combustion zone around the core and this air serves to control stoichiometry for low $NO_X$ formation which emissions predominate at higher powers. In this way the secondary combustion occurs in an annulus surrounding the primary combustion core. When the combustion is substantially complete in both zones large diameter holes in the walls of the combustor in the dilution area downstream of the combustion area provide an effective rapid mixing of the products of combustion with the dilutant air for rapid temperature reduction of the gases.

According to the invention, the nozzle is a hybrid nozzle having a primary fuel atomizing nozzle and a secondary aerating nozzle with the primary nozzle discharging primary fuel in a low angle spray to form a relatively small diameter core substantially centrally of the combustor and with the secondary nozzle in the form of a ring discharging the fuel in a cone surrounding but desirably not overlapping with the core to form a secondary combustion zone in the form of an annulus extending downstream in the space between the primary core and the combustor wall. With the engine at idle or low power with only primary fuel, the high temperature core provides an optimum environment for reducing hydrocarbon and carbon monoxide emissions. At high power, with both primary and secondary fuels introduced, combustion in both zones is essentially discrete and both combustion zones are operating at favorable conditions to minimize undesirable emissions.

The copending application of Sturgess et al., Ser. No. 3,457 filed Jan. 15, 1979 accomplishes the staging of combustion by axial spacing of the primary and secondary combustion with secondary combustion occurring downstream of the primary combustion by the admission of secondary combustion air through large diameter high penetration holes in the part of the combustor wall surrounding the secondary combustion space. The present invention utilizes radial rather than axial staging to accomplish the same result.

The foregoing and other objects, features, and advantages of the present invention will become more apparent in light of the following detailed description of preferred embodiments thereof as illustrated in the accompanying drawing.

DESCRIPTION OF THE PREFERRED EMBODIMENT

Figure 1:
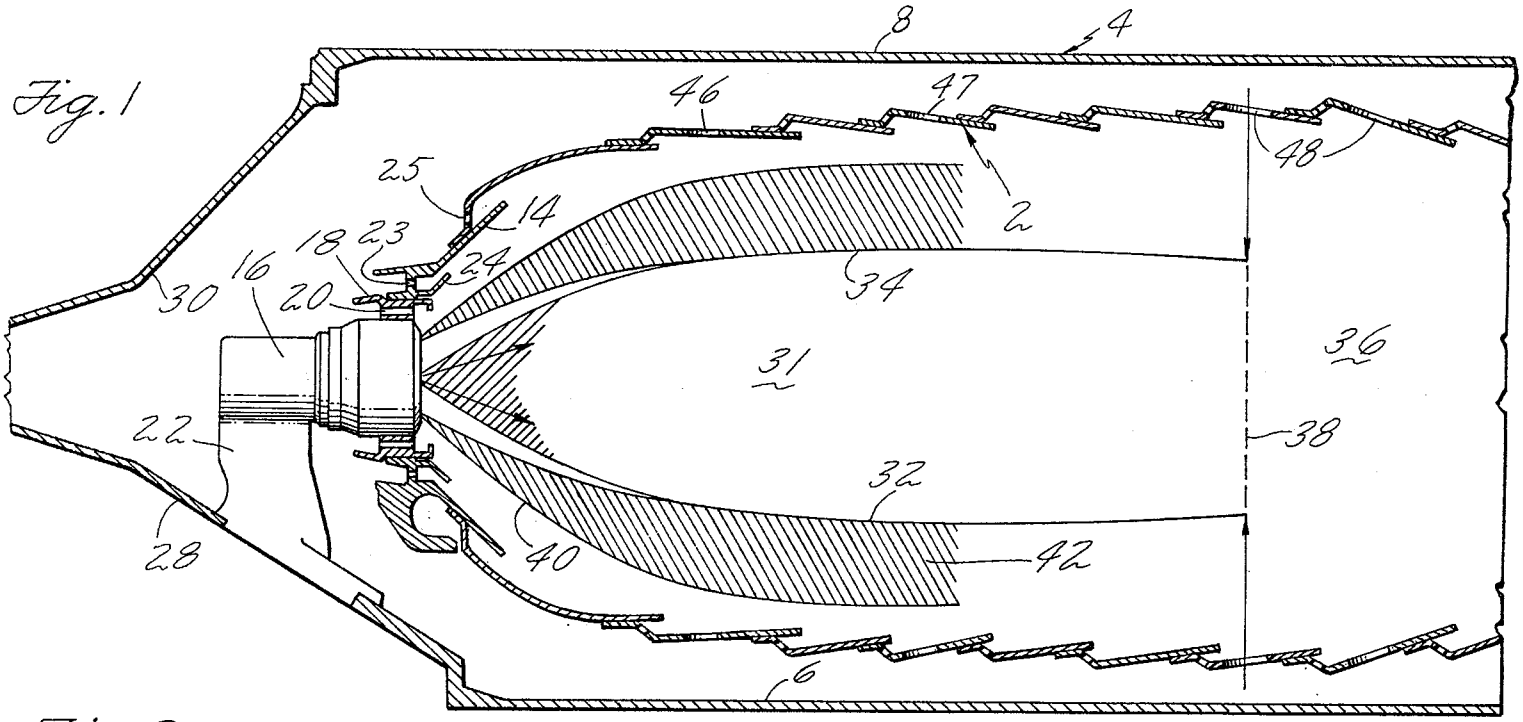
FIG. 1 is a longitudinal sectional view through a combustion chamber incorporating the invention.

Referring first to FIG. 1, the combustion chamber or can 2 is positioned within a burner case 4 having inner and outer walls 6 and 8 which form a burner duct for gases from the compressor discharge, not shown, at the left of FIG. 1 to the turbine inlet, also not shown, at the right of FIG. 1. In the arrangement shown, the walls 6 and 8 form an annular space therebetween surrounding the axis of the turbine engine, and the chamber 2 is one of several cans located in circumferentially spaced relation within this annular space. The invention could be adapted to an annular combustion chamber construction.

The upstream end of the can 2 has an end cap 14 in which is centrally positioned the fuel nozzle 16. This nozzle includes a peripheral ring 18 having therein a row of axial holes 20. The nozzle 16 is mounted on a bracket 22 through which fuel is supplied to the nozzle. The ring 18 fits within the cap which is secured at its outer edge to the sidewall of the can and is essentially imperforate in the area around the nozzle except for small cooling holes 23. The cap has a louver 24 overlying the holes 23 and guiding the air from these holes against the inner surface of the cap. The outer edge of the cap may extend over another set of cooling holes 25 in the upstream end of the sidewall and cooling air from these holes is guided over the inner surface of the can for cooling.

Surrounding the nozzle and bracket are converging inner and outer wall extensions 28 and 30 of the walls 6 and 8 that form a divergent flow area from the compressor to the burner. The cooling air and air for combustion is discharged through the space between these walls 28 and 30.

The primary burning zone or core 31 represented by the lines 32 and 34 terminates about at the upstream end of the dilution zone 36, this dividing line being represented by the dotted line 38. Air entering the axially extending holes 20 at idle forms a cylinder of air at about the periphery of the primary zone and tends to maintain the desired cylindrical configuration of this zone as shown.

At all engine operations above idle the primary zone is surrounded by the hollow cone 40 and annulus 42 of the secondary burning zone. This cone or secondary zone surrounds the primary zone at least to the dilution zone.

Additional air for combustion in the secondary zone, in addition to that mixed with the fuel, is supplied by rows of holes 46 and 47 in the wall of the combustion chamber. These holes are constructed so as to produce relatively low velocity jets that penetrate into the zone or annulus 42 but not into the primary zone or core. The dimension and number of these holes is such as to control stoichiometry in this zone for reducing flame temperature which in turn reduces $NO_X$ formation.

In the dilution zone 36, downstream of the line 38, dilution air in large quantity is discharged into the zone 36 through large holes 48 to mix with and quickly reduce the temperature of the gases entering this zone.

Figure 2:
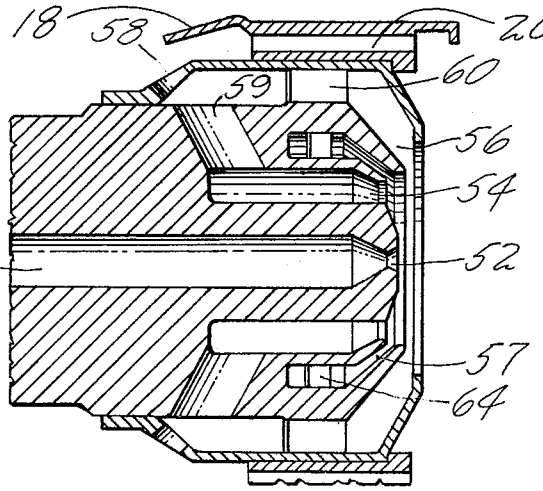
FIG. 2 is a sectional view through the duplex fuel nozzle.

To accomplish the primary and secondary burning as above described, the fuel nozzle is a hybrid nozzle as shown in FIG. 2 in which the primary fuel is discharged through a central passage 50 with the discharge end being shaped as at 52 to cause atomization of the fuel discharging from this passage. At idle operation, on primary fuel only, the nozzle and ring air acts on the primary fuel to produce a low angle spray and mixes with the fuel to form a fuel rich combustion zone or core, desirably a stoichiometry of 1.0, which, as above stated, is centrally located within the combustor and extends axially of the combustor. The discharge is so controlled as to assure substantially complete combustion upstream of the dilution zone (the line 38). The residence time of the fuel and air mixture in the relatively long primary zone leaves time for the CO to convert to $CO_2$. Additionally the low spray angle keeps the fuel well away from the walls and thus avoids quenching of unburned fuel at the cold wall surfaces.

Surrounding the passage 50 are two annular air discharge passages 54 and 56 and between these two discharge passages an annular fuel nozzle 57. At high power operation with both primary and secondary fuel being supplied the air from these discharge passages mixes with and aerates the fuel from the nozzle 57 as it discharges in the hollow conical configuration 40 for the secondary combustion. Additionally, the air from the axial holes 20 now intersects and mixes with the secondary fuel and air. It is expected that up to 90% of the fuel will be discharged as secondary fuel at high powers. Compressed air reaches the discharge passages 54 and 56 through passages 58 and 59 in the walls of the nozzle. Additional air for secondary combustion and for quenching is from the holes 47.

The outer air passage 56 may have a row of swirl vanes 60 therein and an inturned flange at the discharge end so that air is discharged in a swirling annulus. The swirling air flows from passages 54 and 56 and, with the flow of air from holes 20 serves to control the spray angle of the cone of fuel to some extent. Further the secondary fuel is swirled by the configuration of the nozzle and by the tangential holes 64 thus forming a conical spray for the secondary combustion. The swirl vanes 60 are radially inward of the holes 20 of FIG. 1.

The staging described results in significantly reduced emissions expected to meet the proposed low 1981 limits. This is accomplished as above described by the dual hybrid nozzle with the air ring which is capable of discharging atomized primary fuel in a low angle spray and aerated secondary fuel in a surrounding hollow cone. This combines with the particular air admission holes above described to produce the desired emission reduction.

During idle operation where the major problem is carbon monoxide and hydrocarbon emissions only the primary nozzle is operating. Air for combustion with the primary fuel is supplied essentially by the nozzle construction and the holes 20 in ring 18. No additional air enters the primary combustion area so that a fuel rich hot core exists in the primary zone to provide an optimum environment for reducing both hydrocarbon and carbon monoxide emissions. As above stated it is desirable to have the stoichiometry as near unity as possible for complete combustion.

Above idle, both primary and secondary fuel nozzles are in use. The primary combustion continues as before but in addition secondary fuel discharges in the hollow cone configuration. This mixture is fuel rich as discharged from the nozzle but the mixing of this mixture with air from the holes 46 and 47 so controls the stoichiometry as to control the $NO_X$ formation reaction thereby reducing these $NO_X$ emissions which predominate at high engine powers.

This novel concept of radial staging makes possible the updating of engines with this concept merely by a change of nozzle and combustor. With the length and diameter of the combustor no greater than the conventional combustor, there is no need for significant engine changes in currently used engines.

Figure 3:
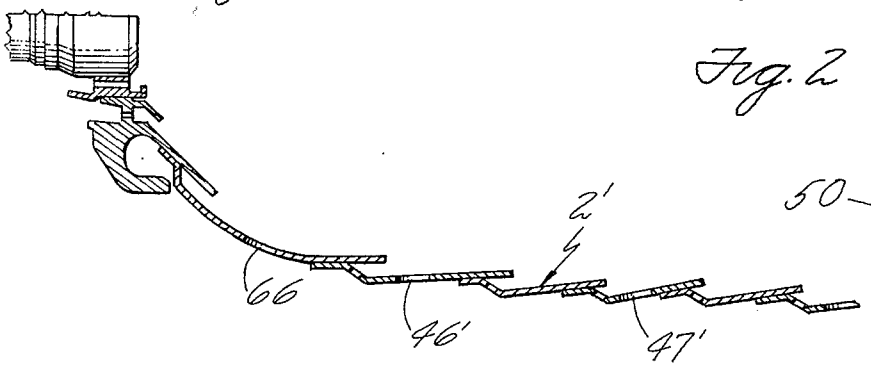
FIG. 3 is a fragmentary sectional view of a part of a modified chamber wall.

As shown in FIG. 3, the can 2' is similar to that of FIG. 1 except that it has, in addition to the rows of holes 46' and 47' corresponding to the holes 46 and 47 of FIG. 1, another row of holes 66 near the upstream end of the can wall. These holes are so located and constructed, when used, as to discharge high velocity jets of air to penetrate into the low angle spray the primary core. These jets serve to adjust the stoichiometry of the fuel and air mixture in the core to unity if needed. Most of the air is provided by the nozzle at idle conditions and in many cases these holes may be avoided as in FIG. 1. However, addition of these holes is an easy way to add more air if needed for primary combustion.

In both FIG. 1 and FIG. 3, the arrangement is such that at idle no fuel is sprayed onto the wall or end cap of the burner can and thus quenching or cooling of unburned fuel is avoided. The arrangement of the airflow within the nozzle and externally of the nozzle is such as to assure maintenance of the primary and secondary flows in the desired pattern so that primary combustion is essentially separate from and independent of secondary combustion. The radial positioning of the secondary zone around the primary zone permits these independent combustion zones within a burner can of the conventional dimensions but with a significant improvement in emissions control.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United State is:

1. A burner construction including:

a burner duct;

a can in said duct having an upstream end cap;

a fuel nozzle in said cap having:

means for delivering primary fuel in a low angle spray for idle and low power, other means surrounding said first means for delivering secondary fuel in a hollow cone surrounding and spaced from the low angle spray for higher power operation with the primary fuel; and a row of axially extending holes in said cap surrounding the nozzle to direct a flow of air axially around the spray of primary fuel.

2. A burner as in claim 1 including a row of holes in the can adjacent the end cap constructed to deliver high velocity jets of air into the low angle spray.

3. A burner as in claim 1 including rows of holes in the can wall to direct low velocity air jets into the space around the low angle spray.

4. A burner as in claim 1 including a row of holes in the can adjacent the end cap to deliver high velocity jets of air radially of the can into the low angle spray; and other rows of holes in the can downstream of said first row to deliver low velocity stream of air into the hollow cone zone around the low angle spray.

5. A burner as in claim 4 including at least one row of dilution holes downstream of said other rows of holes.

6. A burner construction including:

a burner can having a cap at its upstream end;

a nozzle in said cap;

means for discharging two discrete fuel sprays from said nozzle, one a hollow conical spray for high power operation and the other a low angle atomized spray within the hollow cone for idle and low power operation; and a row of axially extending holes in said cap surrounding the nozzle to direct a flow of air axially around the spray of primary fuel.

7. A burner as in claim 6 in which the low angle spray is atomized and is the primary fuel for low power operation and the other is the secondary fuel operating at high power conditions together with the primary fuel.

8. In the operation of a burner for a gas turbine engine to reduce emissions of CO, $NO_X$ and unburned hydrocarbons the steps of:

providing a primary combustion zone in the form of a core centrally of the burner for operation substantially at stoichiometric at idle and low power; and providing a secondary combustion zone in the form of a hollow annulus surrounding and spaced from said primary core for operation with the primary core at high power, the combustion in both zones being in substantially the same location axially of the burners.

9. The process of claim 8 in which the annulus is a hollow cone at the inlet end that merges into an annulus surrounding the primary core.

10. The process of claim 8 including the step of injecting primary fuel as an atomized spray and secondary fuel into the secondary zone in the form of the hollow cone.

* * * * *